US006331518B2

(12) United States Patent
Hemm et al.

(10) Patent No.: US 6,331,518 B2
(45) **Date of Patent: *Dec. 18, 2001**

(54) COMPACT CLEANER CONTAINING SURFACTANTS

(75) Inventors: Dieter Hemm; Guenter Hellmann, both of Hilden (DE)

(73) Assignee: Henkel-Ecolab GmbH & Co. OHG, Dusseldorf (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/147,975

(22) PCT Filed: Sep. 23, 1997

(86) PCT No.: PCT/EP97/05218

§ 371 Date: Mar. 24, 1999

§ 102(e) Date: Mar. 24, 1999

(87) PCT Pub. No.: WO98/13466

PCT Pub. Date: Apr. 2, 1998

(30) Foreign Application Priority Data

Sep. 24, 1996 (DE) ..... 196 39 118
Nov. 21, 1996 (DE) ..... 196 48 107

(51) Int. Cl.[7] ..... C11D 3/04; C11D 3/20; C11D 3/30; C11D 17/00

(52) U.S. Cl. ..... 510/445; 510/225; 510/349; 510/350; 510/351; 510/403; 510/446; 510/447; 510/451; 510/499; 510/506; 510/531

(58) Field of Search ..... 510/302, 349, 510/350, 351, 225, 367, 375, 403, 445, 446, 447, 451, 506, 499, 531

(56) References Cited

U.S. PATENT DOCUMENTS

| | | | | |
|---|---|---|---|---|
| 3,607,764 | | 9/1971 | Crotty et al. | 252/139 |
| 4,342,739 | | 8/1982 | Kakimi et al. | 424/1 |
| 4,590,237 | | 5/1986 | Wuhrmann et al. | 524/480 |
| 4,753,755 | | 6/1988 | Gansser | 252/527 |
| 4,801,396 | | 1/1989 | Altenschoepfer et al. | 252/99 |
| 4,816,821 | | 3/1989 | Loesel | 323/284 |
| 6,028,113 | * | 2/2000 | Scepanski | 514/643 |

FOREIGN PATENT DOCUMENTS

| | | |
|---|---|---|
| 30 00 483 | 7/1980 | (DE) . |
| 31 38 425 | 4/1983 | (DE) . |
| 34 00 008 | 7/1985 | (DE) . |
| 36 33 518 | 4/1988 | (DE) . |
| 41 17 032 | 11/1992 | (DE) . |
| 42 28 786 | 3/1994 | (DE) . |
| 43 23 410 | 1/1995 | (DE) . |
| 196 20 249 | 11/1997 | (DE) . |
| 59 182870 | 10/1984 | (JP) . |
| 61 296098 | 12/1986 | (JP) . |
| WO95/04124 | 2/1995 | (WO) . |
| WO95/18213 | 7/1995 | (WO) . |
| WO96/27653 | 9/1996 | (WO) . |
| WO97/41203 | 11/1997 | (WO) . |

OTHER PUBLICATIONS

Database WPI, AN–87–040197, XP002054046 (Dec. 1986).

* cited by examiner

*Primary Examiner*—Gregory Delcotto
(74) *Attorney, Agent, or Firm*—Andrew D. Sorensen; Ecolab Inc.

(57) ABSTRACT

A water-containing solid detergent having a delayed, controllable and variable hardening time after addition of all the components produced by providing a) aqueous 42 to 55% lye, in a quantity of 21 to 70% by weight, b) mixing with the aqueous lye a compound selected from the group corresponding to formula (I):

$$HOCH_2CH(R^1)OR^2 \quad (I)$$

in which $R^1$ is a hydrogen atom or a methyl group and $R^2$, independent of $R^1$, is a hydrogen atom, a $C_{1-4}$ alkyl group, a group $CH_2CH(R^3)0R^4$ or a group $CH_2CH(R^5)OCH_2$—$CH(R^6)OR^7$, where $R^3$, $R^5$, and $R^6$ represent hydrogen atoms or methyl groups and $R^4$and $R^7$ represent hydrogen atoms or $C_{1-4}$ alkyl groups, and compounds corresponding to formula II:

$$[HOCH_2CH(R^8)_{3-x}NH_x \quad (II)$$

in which $R^8$ is a hydrogen atom or a methyl group and x is the number 0, 1 or 2, in a total quantity of 0.5 to 40% by weight, adding thereto c) a foam inhibitor, builder component, paraffin oil, or surfactants, or polyhydroxy compounds in the order given, and finally adding thereto d) 2% to 25% by weight of solid alkali metal hydroxide, all weights being based on the weight of the detergent.

8 Claims, No Drawings

COMPACT CLEANER CONTAINING SURFACTANTS

BACKGROUND OF THE INVENTION

FIELD OF THE INVENTION

This invention relates to water-containing detergents based on alkali metal hydroxide with a delayed, controlled and variable hardening time. To adjust the solid consistency required, the detergents contain glycols, glycol derivatives and/or certain alkanolamines and alkali metal hydroxide in solid form. The hardening of the water-containing detergent can be delayed by adding paraffin oil and/or surfactants and other components from the group of polyhydroxy compounds in a specific sequence.

Highly alkaline detergents are now commercially available in various forms, for example as powders, granules, liquids, fused blocks or tablets.

Each of these various forms has specific advantages and disadvantages for a given application. Powders, granules and liquids have been successfully used for cleaning textile surfaces or for the manual mechanical cleaning of hard surfaces while tablets or block-form detergents (fused blocks) obtained by melting and subsequent cooling are being increasingly used in addition to powders, granules or liquids for the machine cleaning of hard surfaces, for example for machine dishwashing. Tablets and fused blocks have the advantage over powders of simple, precise "dosing", no dust emission and easy handling.

These advantages may be utilized, for example, in domestic dish-washers, but above all in continuous institutional dishwashing machines in which the articles to be cleaned pass through various washing zones.

It has now been found that very hard tablets and very hard fused blocks have disadvantages. For example, very hard tablets can be damaged by breaking. Tablets damaged in this way naturally no longer have the advantage of precise dosing. Another problem with tablets is that the required solubility in water cannot always be guaranteed, i.e. tablets occasionally dissolve either too quickly or too slowly. Although fused blocks show high fracture resistance in transit, these very hard detergents are problematical to dose from relatively large containers. In addition, both tablets and fused blocks have hitherto required elaborate production processes which, in view of the alkaline melts involved, impose particularly stringent demands on the materials used and the conditions selected.

The detergents obtained are also expected to show a high degree of homogeneity. With solid detergents, however, this is often difficult to achieve. This problem does not affect liquid detergents, which can easily be stirred, as much as it does solid detergents. Accordingly, it would be desirable to have the homogeneity of a liquid, a viscous liquid or a stirrable paste which subsequently hardens into a solid of controllable, variable hardeness in order at this stage to utilize its advantages in regard to storage, transport and dosing. It would be particularly desirable if stirrability could be maintained at temperatures of up to about 40° C. because even temperature-sensitive components could then be added. From the applicational point of view, it would be of particular advantage to prevent premature hardening of the material in the equipment used during the production process. Effective control of the parameters which critically influence the hardening process would be particularly desirable.

The problem addressed by the present invention was to provide highly alkaline general-purpose detergents based on alkali metal hydroxide, preferably sodium or potassium hydroxide, more preferably sodium hydroxide, for textile surfaces, but preferably for cleaning hard surfaces, for example for dishwashing, and in particular detergents for institutional dishwashing machines which would combine the advantages of powders and liquids on the one hand and the advantages of tablets and fused blocks on the other hand. In other words, the problem addressed by the present invention was to provide detergents which would show defined solubility under various in-use conditions, but which on the other hand would be stable in transit and in storage and, in addition, could be dosed quickly, simply and with precision, would not emit any dust and could be produced in a technically simple manner and which would be easy to package. In particular, stirrability during production, hardness variable under control and delayed hardening during production and storage would afford major advantages and would be taken into account. At the same time, the invention set out to provide a process which would enable temperature-sensitive substances to be incorporated, if necessary even below 42° C., without in any way impacting on the other problems addressed by the invention.

The requirements which detergents are expected to meet, such as good cleaning performance, fat dissolving power, etc., would of course also have to be satisfied at the same time.

Both viscous or paste-like detergents and solid detergents in tablet or block form are already known from the prior art.

DISCUSSION OF RELATED ART

For example, according to DE-OS 31 38 425, the rheological behavior of the detergents disclosed therein is such that a gel-like paste can be liquefied by application of mechanical forces, for example by shaking or by application of pressure, to a deformable storage bottle or tube or by means of a metering pump and readily expressed from a spray nozzle.

U.S. Pat. No. 3,607,764 describes solid glass cleaning compositions which can be diluted to form a sprayable solution. These compositions contain inter alia sodium or potassium hydroxide, sodium or potassium tripolyphosphate, sodium or potassium pyrophosphate, hydroxycarboxylic acid builder, a water-soluble nonionic surfactant, alkylene glycol ether and optionally sodium carbonate. The control of viscosity or hardness as proposed by the present invention is not mentioned.

JA 84/182870 describes solutions of alkali metal hydroxides in glycols or alcohols which become viscous through neutralization with long-chain carboxylic acids and which assume a paste-like consistency through the addition of silicone oil, so that they may be used as pastes for oiling leather.

JA 86/296098 describes water-free solid detergents based on alkali metal hydroxides. In this case, the alkali carrier is mixed with alkanolamines and water-soluble glycol ethers so that a solid detergent is obtained. The Japanese patent in question does not give any technical teaching on the variable reduction of hardness or on the control of the hardening process.

DESCRIPTION OF THE INVENTION

The present invention relates to a water-containing solid detergent with a delayed, controllable and variable hardening time after addition of all the components, characterized in that it is produced by a process in which a) aqueous lye, preferably potash or soda lye, more preferably soda lye, preferably 42–55% soda lye, in a quantity of 21 to 70% by weight and preferably 35 to 55% by weight and, to build up a high viscosity, b) a compound corresponding to formula (I):

$$HOCH_2CH(R^1)OR^2 \quad (I)$$

in which $R^1$ is a hydrogen atom or a methyl group and, independently of $R^1$, $R^2$ is a hydrogen atom, a $C_{1-4}$ alkyl group, a group $CH_2CH(R^3)OR^4$ or a group $CH_2CH(R^5)OCH_2CH(R^6)OR^7$, where $R^3$, $R^5$ and $R^6$ represent hydrogen atoms or methyl groups and $R^4$ and $R^7$ represent hydrogen atoms or $C_{1-4}$ alkyl groups, and/or compounds corresponding to formula (II):

$$[HOCH_2CH(R^8)_{3-x}NH_x \quad (II)$$

in which $R^8$ is a hydrogen atom or a methyl group and x is the number 0, 1 or 2, in a total quantity of 0.5 to 40% by weight and preferably 1 to 10% by weight (all percentages by weight are based on the detergent as a whole) are mixed and c) foam inhibitors and builder components and/or paraffin oil and/or surfactants and/or polyhydroxy compounds, preferably glycerol, and/or alkali metal hydroxide, preferably potassium or sodium hydroxide, more preferably sodium hydroxide in solid form, are optionally added.

The delayable hardening time is measured by continuing stirring after all the components have been added and observing it until it comes to a stop through hardening. At the point in time which is known as hardening and which can be controlled, the composition—purely phenomenologically—has a consistency in which it is unable, as required, to flow out through an outflow tube located in the bottom of a production vessel or from an inverted glass beaker.

Accordingly, the detergent according to the invention has, for example, such a consistency that it is unable to flow out from a container, for example an inverted open glass beaker, at 20° C. to 40° C. However, the consistency according to the invention can also be manifested, for example, in the form of resistance to cutting. Many of the detergents according to the invention can still be shaped by compression during processing and storage.

Particularly preferred detergents are obtained if, after the compounds of formula I and/or II have been stirred in, first foam inhibitors and builder components, then surfactants and/or paraffin oil and/or polyhydroxy compounds and, finally, up to 35% by weight and preferably 2 to 25% by weight, based on the detergent as a whole, of solid alkali metal hydroxide, preferably potassium or sodium hydroxide and, more preferably, sodium hydroxide are added.

The present invention also relates to a process for the production of these detergents and to the use of the detergents for machine dishwashing.

A key factor in achieving the required consistency or the delayed hardening is the co-ordination according to the invention of all the ingredients, the order in which they are added and their concentration for obtaining special features.

For example, it has been found that the solid mixtures described in U.S. Pat. NO. 3,607,764 cannot be converted into the solid detergent according to the invention with the required controllable rheological properties simply by gradual dilution with water.

It was also found in the cases investigated that the introduction of NaOH (liquid) into alcohols or glycols together with more solid NaOH fails to give homogeneous detergents which harden under control.

Conversely, however, it was surprisingly found that, providing the composition is selected in accordance with the invention, no other additives apart from the thickener and, for example, solid alkali metal hydroxide, preferably potassium or sodium hydroxide, more preferably sodium hydroxide, and paraffin oil and/or surfactants and/or polyhydroxy compounds, preferably glycerol, are needed to obtain the required hardening effect according to the invention in aqueous sodium hydroxide. In addition, it is emphasized that, even the addition of the compounds corresponding to formula I or II together with alkali metal hydroxide, preferably potassium or sodium hydroxide, more preferably sodium hydroxide, is sufficient in itself to achieve the required controllable firmness. Through the addition sequence according to the invention and the concentration of paraffin oil, surfactants, polyhydroxy compounds, preferably glycerol, and solid NaOH, this firmness can be kept in a stirrable state at a reasonable temperature over an applicationally favorable period, in other words a controllable delay in hardening can be achieved.

Finally, the water content is another critical parameter and is between 10 and 35% by weight and advantageously between 20 and 30% by weight.

In view of the high NaOH content, the pH value of the detergents according to the invention is above 13.

In addition, however, the detergents according to the invention may be used in combination with other ingredients without losing the variable hardness according to the invention. Accordingly, the detergent of lye, preferably potsh and soda lye, more preferably soda lye, substance I and/or II and solid alkali metal hydroxide, preferably sodium hydroxide, and also surfactants and/or paraffin oil and/or polyhydroxy compounds, preferably glycerol, acts as a carrier phase for other ingredients typically encountered in detergents.

Suitable surfactants are both anionic surfactants and cationic surfactants, amphoteric surfactants and nonionic surfactants. The hardening time after all components have been added is particularly dependent on their concentration. Low-foaming surfactants, above all nonionic surfactants, may also be used in a quantity of up to 10% by weight, preferably in a quantity of I to 5% by weight and more preferably in a quantity of 2 to 4% by weight. Extremely low-foaming compounds are normally used for machine dishwashing. These compounds preferably include $C_{12-18}$ alkyl polyethylene glycol polypropylene glycol ethers containing up to 8 moles ethylene oxide units and 8 moles propylene oxide units in the molecule. However, other known low-foaming surfactants, for example $C_{12-18}$ alkyl polyethylene glycol polybutylene glycol ethers containing up to 8 moles ethylene oxide units and up to 8 moles butylene oxide units in the molecule and end-capped alkyl polyalkylene glycol mixed ethers, may also be used.

If the mixtures according to the present invention are to be used for the machine washing of laundry, a relatively high surfactant content of generally up to 20% by weight is recommended. In that case, anionic surfactants from the group of alkyl benzenesulfonates, fatty alcohol sulfates, fatty alcohol ether sulfates and other known anionic surfactants are used in particular in addition to nonionic, cationic and amphoteric surfactants.

In the context of the invention, paraffin oil—of which up to 10% by weight may be present in accordance with the invention—is understood to be a long-chain branched or unbranched hydrocarbon. In one preferred embodiment, it is added to the detergents according to the invention in a quantity of 0.1 to 8% by weight and, more preferably, in a quantity of 0.5 to 5% by weight.

Organic polyhydroxyl compounds are understood in particular to be polyhydric alcohols, preferably glycerol, although other polyhydroxy compounds, for example glucose, also show the effect according to the invention. Functional groups generally have no effect on the result achieved in accordance with the invention. Thus, glycolic acid, for example, or even aldehydes or dialdehydes, for example glyoxal, which are rearranged under the highly alkaline conditions into substituted mono- or polyhydroxy compounds, for example glycolic acid, may be used, but are by no means preferred.

Accordingly, the detergents may optionally contain a builder in a quantity of up to 60% by weight and preferably in a quantity of 15 to 40% by weight. In principle, the builder present in the detergents according to the invention may be any substance known from the prior art as a builder suitable in the broadest sense for laundry and dishwashing detergents. Water-soluble builders are preferably used. The coated builders known from the prior art may also be used and are even preferred in cases where chlorine-containing bleaching agents are used.

Suitable builders are, for example, alkali metal phosphates which may be present in the form of their sodium or potassium salts. Examples include tetrasodium diphosphate, pentasodium triphosphate, so-called sodium hexametaphosphate and the corresponding potassium salts or mixtures of sodium hexametaphosphate and the corresponding potassium salts or mixtures of sodium and potassium salts.

Complexing agents, for example nitrilotriacetate or ethylenediamine tetraacetate, may also be used. Soda and borax are also builders in the context of the present invention.

Other possible water-soluble builder components are, for example, organic polymers of native or synthetic origin, above all polycarboxylates. Suitable builder components of this type are, for example, polyacrylic acids and copolymers of maleic anhydride and acrylic acid and the sodium salts of these polymer acids. Commercially available products are, for example, Sokalan® CP 5 and PA 30 (BASF), Alcosperse® 175 and 177 (Alco), LMW® 45 N and SPO2 ND (Norsohaas). Suitable native polymers include, for example, oxidized starch (for example DE 42 28 786) and polyamino acids, such as polyglutamic acid or polyaspartic acid, for example as manufactured by Cygnus, Bayer AG, Rohm & Haas, Rhône-Poulenc of SRCHEM.

Other possible builder components are naturally occurring hydroxycarboxylic acids such as, for example, monohydroxy and dihydroxysuccinic acid, α-hydroxypropionic acid, citric acid, gluconic acid and salts thereof. Citrates are preferably used in the form of trisodium citrate dihydrate.

Amorphous metasilicates or layer silicates may also be used as builders. Crystalline layer silicates are also suitable builders providing they are sufficiently alkali-stable. Crystalline layer silicates are marketed, for example, by Hoechst AG (Germany) under the trade name Na-SKS, for example Na-SKS-1 ($Na_2Si_{22}O_{45}.xH_2O$, kenyaite) Na-SKS-2 ($Na_2Si_{14}O_{29}.xH_2O$, magadiite), Na-SKS-3 ($Na_2Si_8O_{17}.xH_2O$), Na-SKS4 ($Na_2Si_4O_9.xH_2O$, makatite), Na-SKS-5 ($\alpha$-$Na_2Si_2O_5$), Na-SKS-7 ($\beta$-$Na_2Si_2O_5$ natrosilite), Na-SKS-11 ($\tau$-$Na_2Si_2O_5$) and Na-SKS-6 ($\delta$-$Na_2Si_2O_5$).

Particularly preferred builders are selected from the group consisting of pentasodium triphosphate, trisodium citrate, nitrilotriacetate, ethylenediamine tetraacetate or mixtures thereof.

Bleaching agents typically used in detergents may also be present in the detergents according to the invention, preferably in quantities of 0.5 to 10% by weight and more preferably in quantities of 1.5 to 10% by weight. They may be selected from the group of oxygen-based bleaching agents, for example sodium perborate as such or even in the form of its hydrates or sodium percarbonate, or from the group of chlorine-based bleaching agents, such as N-chloro-p-toluene sulfonic acid amide, trichloroisocyanuric acid, alkali metal dichloroisocyanurate, alkali metal hypochlorites and agents which release alkali metal hypochlorites, alkali-stable bleaching compositions being particularly preferred. Such compositions may be both alkali-stable substances or components stabilized by suitable processes, for example by surface coating or passivation.

Other possible ingredients of the detergents according to the invention are defoamers. They may be used in concentrations of 0.1 to 5% by weight and preferably in concentrations of 0.5 to 3% by weight where a selected surfactant foams excessively under the prevailing conditions and have a foam-suppressing effect on foaming food residues in the dishwashing machine. Defoamers are understood to be any of the foam-suppressing substances known from the prior art, but especially those based on silicone and paraffin, above all the paraffin-based foam inhibitors described, for example, in DE 34 00 008, DE 36 33 518, DE 30 00 483, DE 41 17 032, DE 43 23 410, WO 95/04124 and hitherto unpublished German patent application P 196 20 249. However, other defoamers may also be used.

Ingredients optionally present are other typical detergent ingredients such as, for example, dyes or alkali-stable perfumes. Although abrasive ingredients may be present in principle, the detergents according to the invention are preferably free from such ingredients.

Although thickeners, for example swellable layer silicates of the montmorillonite type, bentonite, kaolin, talcum or carboxymethyl cellulose, may optionally be used to vary the firmness of the detergents, they are not necessary for achieving the required controllable solid properties and the consistency of the detergents according to the invention, in other words thickeners need not be used.

The use of high-melting paraffins or high-melting polyethylene glycols for hardening mixtures is also not necessary for achieving the outcome according to the invention, but is not ruled out either. Nor is the use of long-chain fatty acids and long-chain fatty acid salts as used in the soap industry (chain lengths between $C_{12}$ and $C_{18}$) necessary for achieving the hardness according to the invention. The production of liquid crystalline structures for thickening is not necessary either.

The present invention is also concerned with the hardening effect of the compounds corresponding to formulae I and II in combination with solid alkali metal hydroxide, preferably potassium or sodium hydroxide, more preferably sodium hydroxide, with respect to lye, preferably potash and soda lye, more preferably soda lye, with the following delay in hardening by the addition of surfactants and/or paraffin oils.

On the one hand, the present invention relates to the use of compounds corresponding to formula I and/or formula II in water-containing machine dishwashing detergents containing alkali metal hydroxide, preferably sodium hydroxide, with subsequent addition of various components in a specific sequence, more particularly paraffin oil and/or surfactants and/or polyhydroxy compounds, preferably glycerol, in combination with the subsequent addition of solid NaOH as a hardening agent.

On the other hand, the present invention relates to a process for hardening aqueous 42 to 55% by weight lye, preferably potash and soda lye, more preferably soda lye. The process according to the invention is characterized in that a compound corresponding to formula I and/or a compound corresponding to formula II is/are added with stirring to such an NaOH solution to form a paste-like composition to which several components or all components from the classes of paraffin foam inhibitors, builders, paraffin oil and/or surfactants and/or polyhydroxy compounds, preferably glycerol, are added before solid alkali metal hydroxide, preferably potassium or sodium hydroxide, more preferably sodium hydroxide, or a mixture of these substances is added to achieve delayed, controlled and variable hardening of the detergent material. The process is carried out at temperatures of generally 20° C. to 50° C., preferably 30° C. to 48° C. and more preferably 38° C. to 42° C.

Since the solubility of NaOH in water increases at relatively high temperatures, the NaOH content of the aqueous solution may even be more than 55% by weight. Conversely, the NaOH content may even be below 42% by weight at relatively low temperatures. Accordingly, the limitation to 42–55% by weight NaOH solutions is essentially confined to temperatures of 20° C. to 25° C. The surfactants which may be selected from all the main classes, i.e. cationic, anionic, amphoteric and nonionic surfactants, are preferably used in the detergent in concentrations of up to 10% by weight, but especially in concentrations of 0.1 to 5% by weight and most preferably in concentrations of 0.5 to 3.7% by weight. The paraffin oils are used in concentrations of up to 10% by weight, preferably in concentrations of 0.1 to 8% by weight, more preferably in concentrations of 0.5 to 5% by weight and most preferably in concentrations of 0.9 to 4.1% by weight. The polyhydroxy compounds, preferably glycerol, are used in concentrations of up to 10% by weight, preferably in concentrations of 0.1 to 8% by weight and more preferably in concentrations of 0.5 to 5% by weight. The concentrations of paraffins and/or surfactants and/or polyhydroxy compounds (preferably glycerol) used are dependent upon the required hardening time.

One particular advantage of the present invention is that the stirrability of the detergent and the resulting advantages are guaranteed at temperatures as low as room temperature. In some cases, for example where the thickened lye, preferably potash and soda lye, more preferably soda lye, shows particularly high viscosity, it can be of advantage to increase the temperature slightly before the solid ingredients are added in order to reduce the viscosity. In almost every case, however, the consistency according to the invention can be achieved below 42° C. and preferably between 38° C. and 42° C., so that even heat-sensitive components, for example chlorine-containing bleaching agents, can be incorporated in the detergents according to the invention.

In one particular embodiment, premature hardening of the detergent as a result of the addition of solid alkali metal hydroxide is counteracted by adding other components, for example foam inhibitors, builders, paraffin oils and/or surfactants and/or polyhydroxy compounds, preferably glycerol, beforehand. All or only certain substances from these classes may be added according to the required hardening time. A maximum hardening time is achieved by adding all the substances mentioned above in that order before solid alkali metal hydroxide is added for hardening. In one preferred embodiment, addition of the compounds corresponding to formula I and/or II is followed by stirring for at least 3 minutes before the addition of the other components which in turn is followed by stirring for at least 3 minutes.

The solid detergents according to the invention may be used, for example, by spraying the detergent of controllable hardness accommodated in a container (holding capacity for example 0.5 to 10 kg) with water and using the detergent thus dissolved, for example by introducing it into a dishwashing machine, for example using dispensers of the type marketed by Henkel Hygiene GmbH (Topmater® P40) or by Henkel Ecolab (V/VT-2000 solids dispenser).

The detergent may be produced, for example, in a stirred tank at 20 to 50° C., preferably at 30 to 48° C. and more preferably at 38 to 42° C. Through the addition of paraffin oils and/or surfactants in a specific sequence, the detergent has the process-related advantage that hardening of the detergent can be delayed to such an extent that no solid deposits accumulate in the production equipment used. The detergent may then be packed in marketing containers at around 40° C. and cooled to around 20° C., for example in a cooling tunnel, to achieve the consistency according to the invention. However, other methods may be used for packaging the detergents and cooling them to room temperature.

Depending on the sequence in which the components are added, the detergents according to the invention harden as a function of time which was determined by time-dependent measurements and which is also influenced to a large extent by the particular concentrations of surfactants and/or paraffin oils in the detergent composition.

EXAMPLES

Detergents 1 to 9 with the compositions shown below were produced with differences in the addition sequence of the components and the composition of the detergents. 50% aqueous soda lyes were introduced into a 2 liter glass vessel and heated to 38–40° C. While 1,2-propylene glycol was slowly stirred in (60 r.p.m.), the temperature rose to around 46° C., after which stirring was continued for 15 minutes, paraffin was added as foam inhibitor and the whole was stirred for another 10 minutes. The temperature was then lowered to 38–40° C. and kept constant. The other components of the compositions were added in the order shown in the Table, followed by stirring for 10 minutes after each addition. After the last component (chlorine carrier) had been added, an expert measured the time the composition took to reach a degree of hardness that made stirring at 38 to 40° C. very difficult or even impossible. Purely phenomenologically, the composition then had a consistency in which it was unable as required to flow out through an outlet pipe in the bottom of a production vessel or from an inverted glass beaker.

The figures in the following Table represent the percentages by weight of the various components. The effect of the addition sequence of the components on the hardening time must be regarded in comparative terms.

All the mixtures are homogeneously stirrable and pourable into containers. However, hardening proceeds at different rates.

The various components and their addition sequence on incorporation and, to a lesser extent, their concentration affect the variable hardening time of the material to different extents. This is briefly explained in the following.

| Ingredient | EI | Ingredient | E2 | Ingredient | E3 |
|---|---|---|---|---|---|
| Sodium hydroxide (50% aq) | 42.1 | Sodium hydroxide (50% aq) | 41.1 | Sodium hydroxide (50% aq) | 41.1 |
| 1,2-Propylene glycol | 6 | 1,2-Propylene glycol | 6 | 1,2-propylene glycol | 6 |
| Paraffin foam inhibitor | 1.5 | Paraffin foam inhibitor | 1.5 | Paraffin foam inhibitor | 1.5 |
| NaOH (solid) (microprills) | 20 | NaOH (solid) (microprills) | 20 | NaOH (solid) (microprills) | 20 |
| Paraffin oil | | Paraffin oil | 1 | Paraffin oil | 3.6 |
| Surfactant | 2.6 | Surfactant | 2.6 | Surfactant | — |
| Sodium tripoly-phosphate | 22 | Sodium tripoly-phosphate | 22 | Sodium tripoly-phosphate | 22 |
| Chlorine carrier (coated) | 5.8 | Chlorine carrier (coated) | 5.8 | Chlorine carrier (coated) | 5.8 |
| Approx. max. stir-ring time in mins. | 5 | Approx. max. stir-ring time in mins. | 5 | Approx. max. stir-ring time in mins. | 5 |

Comparison of Examples E1, E2 and E3 reveals a relatively short hardening time of about 5 minutes in each case. In Example E2, this is shown for the case where addition of the propylene glycol is followed by addition of the paraffin foam inhibitor, then solid NaOH and finally paraffin oil and then surfactants. For same addition sequence, it does not matter to the hardening time if paraffin oil (E1) or surfactants (E3) are omitted.

| Ingredient | E4 | Ingredient | E5 | Ingredient | E6 |
|---|---|---|---|---|---|
| Sodium hydroxide (50% aq) | 42.1 | Sodium hydroxide (50% aq) | 41.1 | Sodium hydroxide (50% aq) | 41.1 |
| 1,2-Propyfene glycol | 6 | 1,2-Propylene glycol | 6 | 1,2-propylene glycol | 6 |
| Paraffin foam inhibitor | 1.5 | Paraffin foam inhibitor | 1.5 | Paraffin foam inhibitor | 1.5 |
| Sodium tripoly-phosphate | 20 | Sodium tripoly-phosphate | 20 | Sodium tripoly-phosphate | 20 |
| Paraffin oil | — | Paraffin oil | 1 | Paraffin oil | 3.6 |
| Surfactant | 2.6 | Surfactant | 2.6 | Surfactant | — |
| NaOH (solid) (microprills) | 20 | NaOH (solid) (microprills) | 20 | NaOH (solid) (microprills) | 20 |
| Chlorine carrier (coated) | 5.8 | Chlorine carrier (coated) | 5.8 | Chlorine carrier (coated) | 5.8 |
| Approx. max. stir-ring time in mins. | 30 | Approx. max. stir-ring time in mins. | 90 | Approx. max. stir-ring time in mins. | 90 |

In Example E4 and in all the following Examples, the addition sequence is varied insofar as a builder component is now added after the foam inhibitors. This is followed in Example E5 by the addition of paraffin oil (no paraffin oil was added in E4), then surfactants and finally solid NaOH and chlorine carrier. Accordingly, the positions of solid NaOH and the builder component are switched. With this addition sequence, the hardening time is increased to 30 minutes in the absence of paraffin oil (E4) or to as long as 90 minutes where paraffin oil has been added, as in Example E5.

In Example E6, the influence of the surfactant component is illustrated more clearly compared with Example E5 by the fact that no surfactant was added. A corresponding composition and addition sequence of the components leads to a hardening time of 90 minutes.

| Ingredient | E7 | Ingredient | E8 | Ingredient | E9 |
|---|---|---|---|---|---|
| Sodium hydroxide (50% aq) | 44.7 | Sodium hydroxide (50% aq) | 43.7 | Sodium hydroxide (50% aq) | 41.1 |
| 1,2-Propylene glycol | 6 | 1,2-Propylene glycol | 6 | 1,2-propylene glycol | 6 |
| Paraffin foam inhibitor | 1.5 | Paraffin foam inhibitor | 1.5 | Paraffin foam inhibitor | 1.5 |
| Sodium tripoly-phosphate | 20 | Sodium tripoly-phosphate | 20 | Sodium tripoly-phosphate | 20 |
| Paraffin oil | — | Paraffin oil | 1 | Paraffin oil | — |
| Surfactant | — | Surfactant | — | Surfactant | 3.6 |

-continued

| Ingredient | E7 | Ingredient | E8 | Ingredient | E9 |
|---|---|---|---|---|---|
| NaOH (solid) (microprills) | 22 | NaOH (solid) (microprills) | 22 | NaOH (solid) (microprills) | 22 |
| Chlorine carrier (coated) | 5.8 | Chlorine carrier (coated) | 5.8 | Chlorine carrier (coated) | 5.8 |
| Approx. max. stirring time in mins. | 5 | Approx. max. stirring time in mins. | 5 | Approx. max. stirring time in mins. | 45 |

In Example E7, neither paraffin oil nor surfactants were added for comparison purposes. In actual fact, the hardening time is not increased in this case despite the modified sequence. As in Examples E1, E2 and E3, it is 5 minutes. Accordingly, Examples 4, 5, 6 and 7 show that both the paraffin oil and the surfactants, by their addition at positions 5 and 6, contribute towards an increase in the hardening time. In Example E8, the surfactant component was not added while the amount of paraffin component added was reduced to 1% by weight compared with E6. In this case, too, the hardening time is only 5 minutes.

In Example E9, no paraffin oil was added and any compensatory effect by increasing the addition of surfactant was investigated. In fact, the hardening time is increased to 45 minutes compared with E4 (30 minutes) by an addition of 3.6% by weight of surfactant.

| Ingredient | F1 (% by weight) | F2 (% by weight) | F3 (% by weight) | F4 (% by weight) | F5 (% by weight) | F6 (% by weight) |
|---|---|---|---|---|---|---|
| Sodium hydroxide (50% aq) | 43 | 39 | 40 | 39 | 38.8 | 38.8 |
| 1,2-Propylene glycol | 5 | 6 | 5 | 6 | 6 | 6 |
| Sodium tripolyhosphate (coated) | 23 | 23 | 23 | 23 | 18.5 | 23 |
| Soda (calc.) | 7 | 7 | 5 | 7 | 6 | 6 |
| Paraffin oil | — | — | 5 | — | — | — |
| Glycerol | — | — | — | 3 | — | 3 |
| Glyoxal (40%) | — | — | — | — | 7.5 | — |
| Surfactant/ foam inhibitor | 1 | 4 | 1 | 1 | 1.2 | 1.2 |
| NaOH (solid) (microprills) | 21 | 21 | 21 | 21 | 22 | 22 |
| Approx. max. stirring time in mins. | ca.10 | ca.40 | ca.90 | ca.180 | ca. 120 | ca. 180 |

The thickened stirrable pastes according to the parent application (for example F1, F2 and F3) can have their hardening times increased according to the amount of glycerol added in relation to the other components, for example to around 180 minutes in Examples F4 and F6.

The addition of aqueous glyoxal (which reacts spontaneously to form glycolic acid or 3-hydroxypropanoic acid under the highly alkaline conditions prevailing) also leads to delayed hardening (120 minutes in Example 5). However, the addition causes a dramatic increase in temperature so that this retarding medium should not be used where it is intended to incorporate temperature-labile substances. At the high pH values, polyhydroxy compounds of the glucose type can lead to brownish discoloration and, accordingly, are not particularly preferred. Where ethylene glycol is used, inhomogeneities occur at relatively high concentrations. The highly alkaline conditions lead to a deposit which again does not meet the conditions a homogeneous commercial product is expected to satisfy.

Accordingly, it may be concluded that both the addition sequence and the concentration of the added components influence the hardening time. The longest hardening time is achieved when both paraffin oil and surfactants and polyhydroxy compounds, preferably glycerol, are added and solid NaOH is only stirred after they have been added.

What is claimed is:

1. A method for preparing a water-containing solid detergent, the method comprising:

providing aqueous 42 to 55% lye in a quantity of 21 to 70% by weight;

mixing with the aqueous lye compound of formula (I), compound of formula (II), or a combination thereof to achieve a quantity of this compound or combination of 0.5 to 40% by weight and to form a first mixture;

formula (I) being:

$$HOCH_2CH(R^1)OR^2 \quad (I)$$

in which $R^1$ is a hydrogen atom or a methyl group, and $R^2$, independent of $R^1$, is a hydrogen atom, a $C_{1-4}$ alkyl group, a group $CH_2CH(R^3)OR^4$, or a group $CH_2CH(R^5)OCH_2—CH(R^6)OR^7$, where $R^3$, $R^5$, and $R^6$ represent hydrogen atoms or methyl groups and $R^4$ and $R^7$ represent hydrogen atoms or $C_{1-4}$ alkyl groups;

formula (II) being:

$$[(HOCH_2CH)(R^8)_{3-x}]NH_x \quad (II)$$

in which $R^8$ is a hydrogen atom or a methyl group, and x is the number 0, 1 or 2;

adding to the first mixture foam inhibitor followed by the addition of 15% to 60% by weight, based on the weight of the detergent, of a building component to form second mixture;

adding to the second mixture as a component: 0.1% to 8% by weight, based on the weight of the detergent, of paraffin oil, 1% to 20% by weight, based on the total weight of the detergent, of surfactant, 0.1% to 10% by weight, based on the total weight of the detergent, of a polyhydroxy compound, or a combination thereof; to form third mixture;

adding to the third mixture solid alkali metal hydroxide to achieve 2% to 25% by weight of the alkali metal hydroxide and to form the detergent;

wherein % by weight is based on the weight of the detergent.

2. The method of claim 1, wherein adding surfactant comprises adding anionic, cationic, amphoteric, or nonionic surfactant.

3. The method of claim 1, wherein adding builder comprises adding pentasodium triphosphate, trisodium citrate, nitrilotriacetate, ethylenediamine tetraacetate, soda, alkali metal silicate, or a mixture thereof.

4. The method of claim 1, wherein:

mixing a compound of formula I comprises mixing ethylene glycol, 1,2-propylene glycol, butyl glycol, or butyl diglycol;

mixing a compound of formula II comprises mixing ethanolamine, diethanolamine, or triethanolamine; or a combination thereof.

5. The method of claim 1, wherein the solid detergent comprises from 10% to 35% by weight of water, based on the weight of the detergent.

6. The method of claim 1, wherein after the addition of the compound corresponding to formula (I) and/or formula II, the mixture is stirred for at least 3 minutes.

7. The method of claim 1, comprising forming a detergent that hardens about 90 to about 180 minutes after forming.

8. The method of claim 7, comprising forming a detergent that hardens 30 to 90 minutes after forming.

* * * * *